US010030903B2

(12) United States Patent
Nguyen

(10) Patent No.: US 10,030,903 B2
(45) Date of Patent: Jul. 24, 2018

(54) BEVERAGE ACTIVE CHILLER

(71) Applicant: Hai T. Nguyen, Deerfield Beach, FL (US)

(72) Inventor: Hai T. Nguyen, Deerfield Beach, FL (US)

( * ) Notice: Subject to any disclaimer, the term of this patent is extended or adjusted under 35 U.S.C. 154(b) by 0 days.

(21) Appl. No.: 15/187,892

(22) Filed: Jun. 21, 2016

(65) Prior Publication Data

US 2017/0363341 A1 Dec. 21, 2017

(51) Int. Cl.
*F25D 3/08* (2006.01)

(52) U.S. Cl.
CPC ..... *F25D 3/08* (2013.01); *F25D 2303/0841* (2013.01); *F25D 2303/0843* (2013.01); *F25D 2303/08221* (2013.01); *F25D 2303/08222* (2013.01); *F25D 2331/803* (2013.01); *F25D 2331/805* (2013.01); *F25D 2331/808* (2013.01); *F25D 2500/02* (2013.01)

(58) Field of Classification Search
CPC ..... F25D 3/08; F25D 2500/02; F25D 2303/0843; F25D 2303/0841; F25D 2331/808; F25D 2331/803; F25D 2303/08222; F25D 2303/08221; F25D 2331/805; F25D 2331/809; F25D 2303/082; F25D 2303/0831; F25D 31/007
See application file for complete search history.

(56) References Cited

U.S. PATENT DOCUMENTS 4,163,374 A * 8/1979 Moore ..... B65D 81/3883 220/592.01
5,653,124 A * 8/1997 Weber ..... A47G 19/2288 62/457.3
5,875,646 A * 3/1999 Rich ..... F25D 3/08 62/457.3
6,330,808 B1 * 12/2001 Kouwenberg ..... F25D 3/08 62/372
7,107,783 B2 * 9/2006 Smolko ..... A41D 13/0053 62/315
9,555,949 B1 * 1/2017 French ..... A47J 41/00
2015/0128637 A1 * 5/2015 Peters ..... F25D 31/002 62/457.4

* cited by examiner

*Primary Examiner* — Michael C Zarroli

(57) ABSTRACT

A mechanical apparatus comprised of a plurality of pods in the form of an annular cylindrical sleeve. All pods containing liquid are to be frozen for the purpose of dynamically transfer/impart its charged thermal energy to a directly contacted beverage object placed within. The pods are joined to each other by latitudinal elastic bands allowing it to expand readily and grip onto varying size beverage containers. Furthermore, the plurality of pods and a beverage container are disposed in an insulated holder; a sealable cap is then inserted to seal off and insulate the discharging of thermal energy therein from ambient conditions. A beverage in the form of can or bottle might be placed in the apparatus to achieve desired chill temperature for an extended length of time in high ambient temperature conditions.

12 Claims, 4 Drawing Sheets

BEVERAGE ACTIVE CHILLER

BACKGROUND OF THE INVENTION

Often times, such as a backyard gathering, an outdoor event, picnicking, camping and boating etc., whereas, the outdoor temperature is usually much warmer than the temperature of controlled indoor setting; a chilled canned or bottled beverage will not be able to maintain its original chilled status for a length of time, especially in boating activities. After about 15 minutes of direct exposure to an elevated ambient temperature; the temperature of a chilled beverage becomes warm and continues to be warmer over time to a state that the beverage may not be as desirable for consumption. Alcoholic drinks such as beer and white wine; refreshment drinks such as soda, juice and water simply taste much better when they are chilled and remain chilled over a length of time. Thus, it is the exact intention of this invention to overcome the undesired above conditions and to deliver a practical and proven solution.

FIELD OF THE INVENTION

This invention provides a complete and easy to use a portable chiller device for chilling a beverage object in the form of a can or bottle. The most important part of the invention is the "active chiller". Think of the active chiller like a rechargeable battery for use and to be reused. In this case, the active chiller comprises a plurality of pods containing liquid; it is to be frozen to become icy condition (charged thermal energy); then it is to be placed/wrapped onto a pre-chilled beverage (pre-chilled beverage is preferred for best result but the beverage can be of normal temperature condition). Together, the pre-chilled beverage with the active chiller are disposed in a cup like structure. A cap with built-in seal structure is installed to seal and insulate the ice cold condition inside. The active chiller's icy condition couples with the pre-chilled beverage are being protected and insulated to provide the desired chilled temperature for an extended length of time. The active chiller is removable, rechargeable and reusable.

DESCRIPTION OF THE PRIOR ARTS

At the present, several devices for chilling a beverage object are known. One type of a known device for chilling a beverage object is comprised of a fixed diameter cylindrical sleeve. Whereas, this invention does not have the flexibility to accept variety of cans or bottles of different diameters. In doing so, there is an annular space existed between the beverage object and the fixed diameter cylindrical sleeve when the beverage object is not of intended size. The annular space has a clear disadvantage because it does not allow for the maximum thermal energy transfer to the beverage object. Such a device is known by U.S. Pat. No. 4,163,374 and U.S. Pat. No. 4,183,226.

A second type of a known device for chilling a beverage object comprises a sleeve-like body structure. The formation of the sleeve with multiple compartments can be best described as a polygon in its natural state. Each compartment further divides into two sub-compartments. The inner compartment requires non-freezing cooling liquid for active chilling and the outer compartment is reserved for a compressible resilient material. There are few disadvantages in this invention. First, the use of non-freezing cooling liquid is not as effective as solid ice for thermal energy. Second, because of its polygon shape, this invention cannot replace a non-freezing cooling liquid with water and still produce the circular shape required for the full contact with the objects. The inherently unpredictable shape of the compartments and the expansion and contraction of the sleeve do not fully contact the can or bottle. Furthermore, each compartment with two sub-compartments and the required use of exotic materials for construction are not a good economic factor. Lastly, by relying on the outer compartment for providing insulation to the cooling device is inadequate due to partial direct exposure of the inner compartment to ambient condition. Such a device is known by U.S. Pat. No. 7,089,757.

A third type of a known device for chilling a beverage object comprises a plurality removable plastic pouch. Each pouch is to be filled with coolant fluid. The disadvantage is if the coolant fluid is non-freezing; then it will not have maximum thermal energy like frozen ice. However, the use of a non-freezing coolant fluid allows for the plurality removable plastic pouch to take the shape of the can or bottle object with full contact. The second disadvantage; the plurality removable plastic pouch does not allows for quick and instant ability to form the hollow cylindrical shape. Such a device is known by U.S. Pat. No. 4,741,176.

Further investigation shows a known device for chilling a beverage object comprises a plurality of chilling members. One disadvantage in this invention is that each chilling member must be placed in a pouch like carrier in order to form a hollow cylindrical shape. Thus, the chilling members do not have direct contact with the beverage object, resulting in a less effective thermal energy transfer. The second disadvantage in the invention is the required wrapping like of the pouch carrier to form a hollow cylindrical shape. This technique does not resulting in a true cylindrical shape due to the variant in different diameters for cans or bottles. Another disadvantage is no chilling members are in direct contact with the beverage object which resulting in a lost effectiveness for all chilling members. Such a device is known by US Patent Application Publication US 2006/0242990 A1.

SUMMARY OF THE INVENTION

It is the object of this invention to provide a new and improved device for chilling a beverage object in which the disadvantages of the known devices have been avoided.

The present invention provides a simple and effective solution to chill a beverage object for an extended length of time under ambient condition. For purposes of this application, the term "beverage" is used to refer to consumable substances of all types and phases, including by way of illustration only and not limited to soft drinks, alcoholic beverages, water, juices, energy drinks and the like. It is also understood that, for purposes of this application, the term "object" is used to refer to containers and receptacles of all types, materials and design constructions, including by way of illustration only and not limited to cans, bottles, cups, glasses and the like.

The apparatus of the present invention is comprised of a generally main portion of a cup like structure for receiving other components of the said invention and including a beverage object within. A removable chiller in the form of an annular cylindrical sleeve is variably expandable, contractible and fits within the main body portion of the apparatus to provide a means by which to produce and maintain desired chill condition for an extended period of time to a beverage object; while being exposed to ambient temperature condition. A removable cap of ring like structure with built-in elastic material capable of expansion and retraction, when placed over the beverage object and attached onto main body portion, providing further protection, insulation and preserving the pre-chilled condition of the beverage object and the frozen condition of the chiller. An optional raiser is included to add more height to a shorter beverage object, thus allowing the full use of the embodiment.

To the accomplishments of the above, this invention may be embodied in the form illustrated in the accompanying drawings, attention being called to the fact, however, that the drawings are illustrative only, and that changes may be made in the specific construction illustrated and described within the scope of the appended claims.

DESCRIPTION OF THE DRAWINGS

For a more complete understanding of the present invention and the advantage thereof, reference is now made to the following description taken in conjunction with the accompanying drawing in which.

DETAILED DESCRIPTION OF THE PREFERRED EMBODIMENTS

Figure 1:
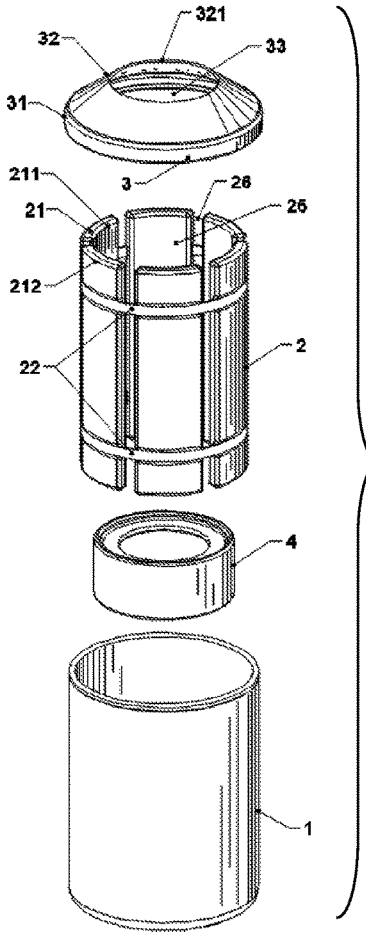
FIG. 1 is an exploded perspective view of the invention.

Referring to FIG. 1, there is shown an embodiment of an apparatus of the present invention. In the preferred embodiment, the apparatus comprises a main body portion 1, a removable chiller 2, a cap 3, and a optional raiser 4.

To make reading and identifying the elements easier to follow; from here on: the body portion 1, a removable chiller 2, a removable cap 3, and a optional raiser 4 will be referred as a cup 1, a chiller 2, a cap 3, and a raiser 4 respectively.

Figure 5:
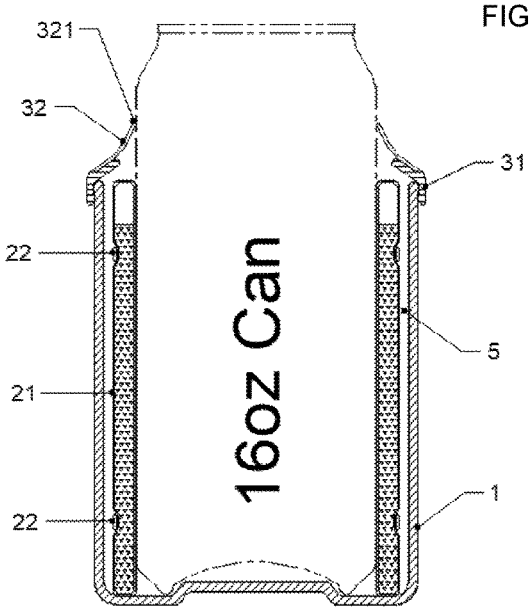
FIG. 5 is a cross sectional front elevation view of the invention with relation to a 16 oz can inserted.
Figure 6:
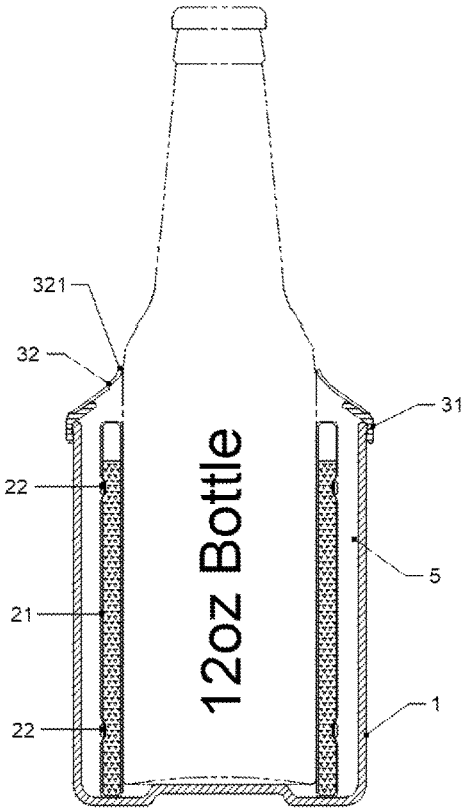
FIG. 6 is a cross sectional front elevation view of the invention with relation to a 12 oz bottle inserted.
Figure 7:
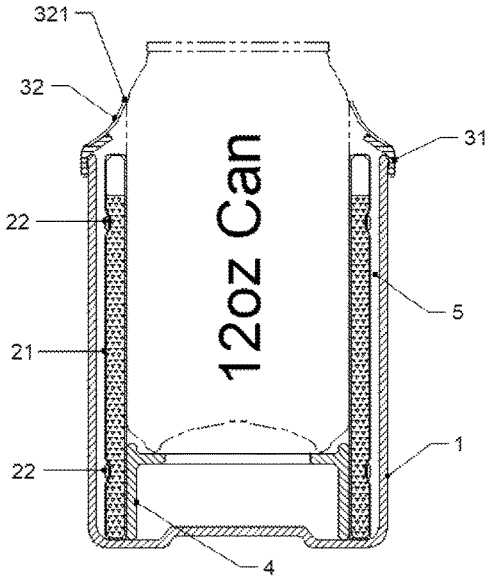
FIG. 7 is a cross sectional front elevation view of the invention with relation to a 12 oz can inserted including the optional raiser.

The main body portion 1 is a cup like configuration designed to receive the chiller 2, a raiser 4 (optional), a cap 3, and a beverage object to be chilled (FIGS. 5-7). The cup 1 is preferably constructed singularly of thermoplastic resins such as Polycarbonate, ABS, LDPE, or HDPE etc. All depended, but not limited to, on the desired strength, durability, cosmetically, availability and cost factor. It is further noted that the cup 1 also be made of metals such as Aluminum, Stainless Steel, Titanium etc. for high end market. With metal construction, there should be consideration of a rubber or thermoplastic layer on the interior wall of cup 1 to insulate/shield the high thermo conductivity associated with the metals. It is to reduce frosting and condensing conditions occur on the cup's exterior wall.

Figure 3:
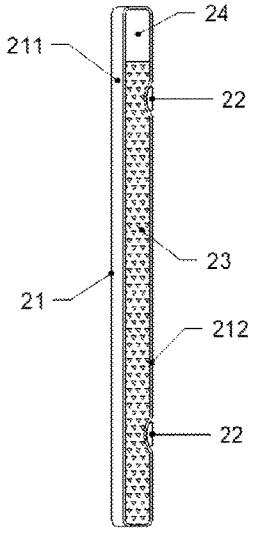
FIG. 3 is a cross sectional view of a pod taken along line 8-8 in FIG. 2.
Figure 4:
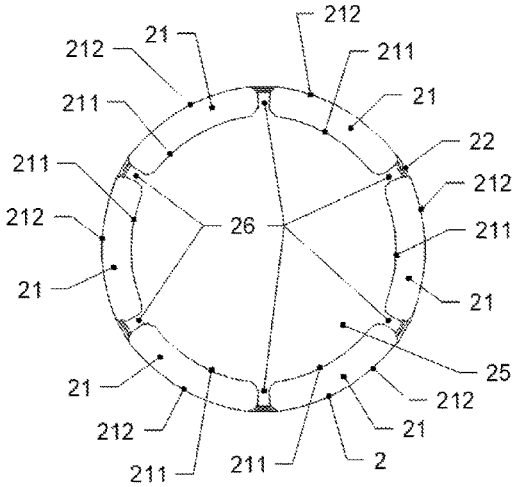
FIG. 4 is a top plan view of the removable chiller assembly.

The chiller 2 comprises of plurality of pods 21, each pod 21 is a partial fraction of an annular cylindrical sleeve (FIG. 4), whereas, the concave side (211) and convex side (212) are of concentric circles. Pods 21 are collectively joined on equal spacing by latitudinal elastic bands 22 to form an annular cylindrical sleeve 2 (FIGS. 1 & 4). A pod 21 is generally constructed of any thermoplastic resins with suitable strength, durability, availability, and cost factor. It is of utmost important, the wall thickness of a pod 21 be constructed as thin as possible, yet still meet the strength and durability requirements, and for maximum thermal energy transfer to a desired object. Because the wall thickness of pod 21 acting as an insulating layer, thermoplastic is not as good as metal in term of thermal conductivity, thus the thermo energy discharge of the thermoplastic pods to an object is less effective when they are in contacted with each other. It is highly preferred that pods 21 be made of metal that has excellent rate of thermal conductivity such as Copper or Aluminum. These metals are highly ductile and can be made very thin wall and yet met the strength and durability requirements. FIG. 3 shown a cross section of a pod 21 filled with distilled water 23 to approximate 90% of its volume. The 10% air volume 24 is allowed for freeze expansion of the distilled water 23 inside. Distilled water 23 is chosen for its purity, non-toxic and faster freezing rate over gel material. The method of filling pods 21 with distilled water 23 then seal off the mean for filling the water is readily known and can be done in variety of techniques, thus it is not discussed here.

The chiller 2 is a plurality of pods 21 (FIG. 4) joined on equal spacing by latitudinal elastic bands 22. A latitudinal elastic band 22 is preferably made of Rubber like materials such as Silicone, Neoprene, EPDM etc. that possessed high UV tolerant, good elongation and good retention characteristics. The significant of the latitudinal elastic bands 22 (FIG. 1) is paramount. The latitudinal elastic bands 22 enable the chiller 2 to expand/contract readily and uniformly the interior compartment 25 to receive different objects of varying diameters (FIGS. 5-7, 9). As the chiller's 2 interior compartment 25 expanding/contracting when receiving/removing a beverage object; it's causing each pod 21 to move out/in diametrically, while the column spaces (26) (FIGS. 1,4,9) between end edges of adjacent pods 21 are also growing/shrinking radiantly and equally accordingly. More and of equal important is the latitudinal elastic bands 22 exerting a radial gripping action upon the inserted object. Naturally, the radial gripping action causing a direct contact of the pods' 21 concave surfaces 211 (FIGS. 1,4,9) with the object. Inherently, the direct and full surface contact and the radial compression force (gripping action) of the chiller 2 imposing on the object are the absolute must desired conditions for maximum transfer of thermal energy.

Figure 2:
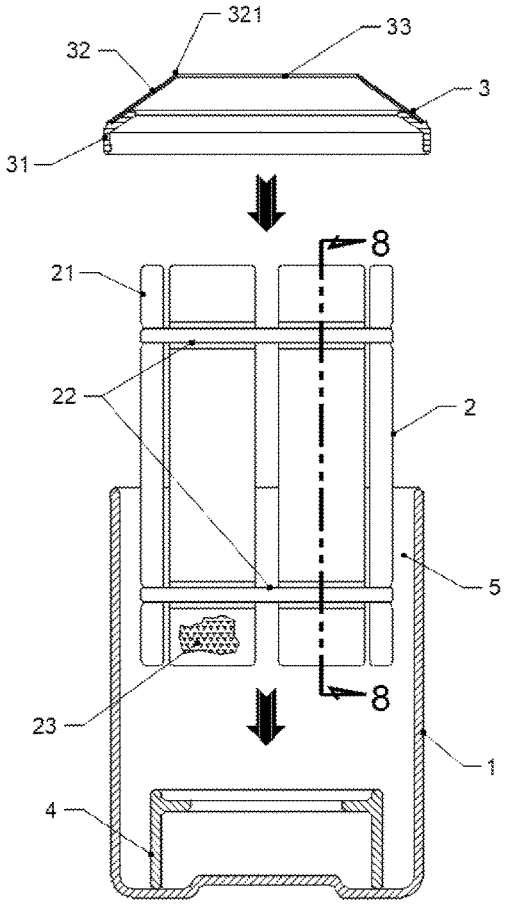
FIG. 2 is an exploded cross sectional front elevation view of the invention.
Figure 8:
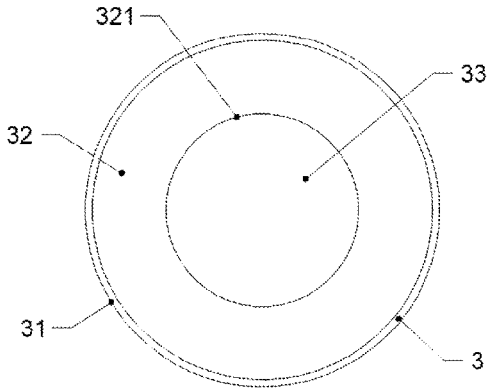
FIG. 8 is a top plan view of the removable cap.
Figure 9:
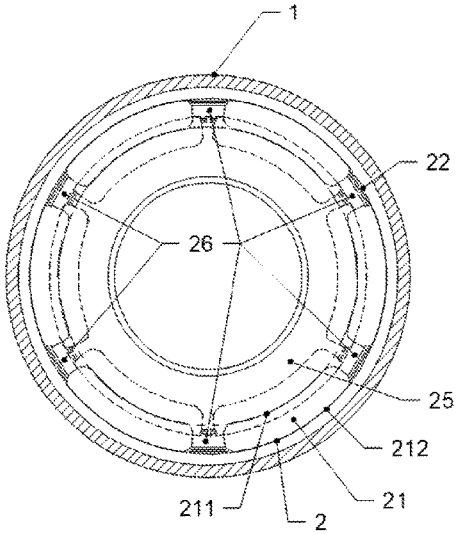
FIG. 9 is a top plan view of the cup with an expanded removable chiller inside. The natural state of the removable chiller is shown as dashed lines.

As more fully illustrated in FIGS. 1 & 2, the cap 3 contributes to the all important of the invention; by capping and sealing off, the dissipation rate of thermal energy from the beverage object and the chiller 2 is trapped, delayed, circulated and insulated from ambient conditions. The cap 3 is comprised of two parts of two different materials molded together. The base cap 31 is preferably constructed of thermoplastics resins with suitable strength, durability, cosmetically, availability, and cost factor. It is designed to press and snap over cup 1. The ring seal 32 is preferably constructed of Silicone, Neoprene, Thermoplastic Elastomer etc. that possesses high UV tolerance, good elongation and good retention characteristics. The aperture 33 (FIGS. 1 & 8) is designed to be smaller than the smallest known diameter of a cylindrical object. The ring seal 32 is made thin so its inner lip 321 can stretch easily over a bigger diameter (FIGS. 5-7) and produce a tight seal on the inserted object. Importantly, the ring seal 32 is molded directly with base cap 31 to form a single part—the cap 3.

Further illustration of the embodiment of the invention is shown the raiser 4 (FIGS. 1, 2 & 7). The raiser 4 is generally constructed of any thermoplastic resins with suitable strength, durability, availability, and cost factor. The raiser 4 is an optional part and used only when an inserted object is shorter than the cup 1 and cap 3 disposed of together. This unique part allows pods 22 being made taller and have bigger volume to produce more thermal energy, and more surface contact with the object. All of which are desired conditions for the best thermal transfer.

FIGS. 5-7 shown an annular space 5. It is important to know that chiller 2 may be distorted and bulged due to freeze expansion of distilled water 23 on each pod 21. The annular space 5 is designed to accommodate the distortion and bulging of the chiller 2 and also providing a separation space to cup 1.

A quick look at FIG. 1, one will note the simplicity of the design and the use of the invention. Prior to usage, the chiller 2 is froze to an icy condition. It is then slips over a pre-chilled canned or bottled object (FIGS. 5-7). Depending on the object's height; the optional raiser 4 will be used as illustrated in FIG. 7. The canned or bottled object together with the chiller 2 and the optional raiser 4 are placed in cup 1. The cap 3 then slips over the object and continues to move down to snap onto the cup 1. The inner lip 321 (FIGS. 1,2,5-7) of seal ring 32 expands and stretches over the object to seal off and insulate the chamber below. Icy condition (charged thermal energy) of the chiller 2 is protected by the sealed chamber. It is being insulated to deliver and maintain maximum coldness to a beverage object for an extended length of time; which is the novelty of the invention.

As known from above, the embodiment of the invention illustrates and details the simple, effectiveness and usefulness of an apparatus to deliver the desired chill temperature to any canned or bottled beverages.

It will be apparent that many applications will lend themselves to utilization of this invention. Although, the invention is particularly suited for chilling canned or bottled beverages, the invention could be modified and utilized for other industries.

While certain novel features of this invention have shown and described in the annexed claims, it will be understood that various omissions, substitutions and modifications in the forms and details of the apparatus illustrated and in its operation can be made by those skilled in the art without departing from the spirit of the invention.

What is claimed is:

1. An apparatus for the purpose of chilling a canned or bottled object, it is comprising:

a. a cup like structure for receiving;

b. a removable chiller of the form annular cylindrical sleeve capable of receiving a canned or bottled object, for which both are placed inside said cup like structure; then c. a removable cap with built-in seal structure to slip over, make contact with the canned or bottled object and latch onto said cup like structure to close-off the chamber within; and d. a raiser for adding more height to a shorter canned or bottled object placed inside said cup like structure.

2. The removable chiller of claim 1, wherein the removable chiller further comprising of a plurality of identical pods, whereas identical pods are collectively joined on equal spacing by latitudinal elastic bands.

3. The removable chiller of claim 1, wherein the removable chiller further comprising of a plurality of identical pods, whereas each identical pod is a partial fraction of an annular cylindrical sleeve.

4. The removable chiller of claim 1, wherein the removable chiller further comprising of a plurality of identical pods, whereas identical pods are collectively joined on equal spacing to form an annular cylindrical sleeve.

5. The latitudinal elastic bands of claim 2, wherein said latitudinal elastic bands are attached permanently and transversely on convex sides of identical pods.

6. The latitudinal elastic bands of claim 2, wherein said latitudinal elastic bands exerting radial compression force upon a cylindrical object placed within said removable chiller.

7. The latitudinal elastic bands of claim 2, wherein said latitudinal elastic bands enabling said removable chiller's interior compartment to expand/contract readily and uniformly when receiving/removing a cylindrical object.

8. The latitudinal elastic bands of claim 2, wherein said latitudinal elastic bands controlling the identical pods of said removable chiller to move out/in diametrically from a central axis when receiving/removing a cylindrical object.

9. The latitudinal elastic bands of claim 2, wherein said latitudinal elastic bands are classified as flexible rings.

10. The identical pods of said removable chiller to move out/in diametrically of claim 8, wherein the column spaces between the ends of adjacent identical pods are grown/shrunk radiantly and equally when receiving/removing a cylindrical object.

11. The identical pods of said removable chiller to move out/in diametrically of claim 8, wherein the annular cylindrical sleeve's natural formation can be reshaped to form an upright or inverted annular conical sleeve when fitting over a conical object.

12. The optional raiser of claim 1, wherein said optional raiser adding more height for a shorter cylindrical object.

* * * * *